US006244845B1

(12) United States Patent
Milligan et al.

(10) Patent No.: US 6,244,845 B1
(45) Date of Patent: Jun. 12, 2001

(54) SERRATED SLIT MELT BLOWN DIE NOSEPIECE

(75) Inventors: Mancil W. Milligan, Lutrell, TN (US); Robert R. Buntin, Baytown, TX (US)

(73) Assignee: The University of Tennessee Research Corporation, Knoxville, TN (US)

( * ) Notice: Subject to any disclaimer, the term of this patent is extended or adjusted under 35 U.S.C. 154(b) by 0 days.

(21) Appl. No.: 09/304,729

(22) Filed: May 4, 1999

(51) Int. Cl.[7] ..... D01D 5/14
(52) U.S. Cl. ..... 425/7; 425/72.2
(58) Field of Search ..... 425/72.2, 382.2, 425/461, 7

(56) References Cited

U.S. PATENT DOCUMENTS 3,806,289 * 4/1974 Schwarz ..... 425/72.2
5,017,112 * 5/1991 Mende et al. ..... 425/72.2
5,098,636 * 3/1992 Balk ..... 425/72.2

* cited by examiner

*Primary Examiner*—Tim Heitbrink
*Assistant Examiner*—Joseph Leyson
(74) *Attorney, Agent, or Firm*—Duane, Morris & Heckscher LLP

(57) ABSTRACT

The present invention relates to a die nosepiece for use in textile processes involving nonwoven melt blow fabrics. In a melt blown process, molten polymer resins are injected into a melt blown die and ejected from the die in the form of filaments. The present invention is directed to an improved die nosepiece comprising a slit with serrated edges through which resin filaments are ejected.

10 Claims, 3 Drawing Sheets

SERRATED SLIT MELT BLOWN DIE NOSEPIECE

BACKGROUND OF THE INVENTION

1. Field of the Invention

The present invention relates to a die nosepiece for use in textile processes involving nonwoven melt blow fabrics. In a melt blown process, molten polymer resins are injected into a melt blown die and ejected from the die in the form of filaments. The present invention is directed to an improved die nosepiece comprising a slit with serrated edges through which resin filaments are ejected.

2. Description of the Prior Art

Prior art nosepieces for dies used in the melt blowing process comprise parallel holes through which resin filaments are ejected. These holes may be formed by drilling or by electric discharge machining (EDM). Multihole dies are expensive to fabricate. The present invention provides a melt blown die that is less expensive to fabricate than prior art dies.

There is also a limit regarding how small holes can be formed in prior art dies. The serrated slit of the present invention can also be made narrower than hole diameters can be made small in prior art dies comprising parallel holes.

SUMMARY OF THE INVENTION

The present invention is directed toward a die nosepiece for a melt blowing device. The present invention comprises a body defining a resin receiving volume. The body further comprises a front section. The invention comprises a resin inlet in fluid communication with the resin receiving volume.

The invention further comprises a slit extending across the front section of the body. The slit comprises a first side and a second side. A serrated first edge is mounted on the front section adjacent the first side of the slit. A serrated second edge is mounted on the front section adjacent the second side of slit.

DESCRIPTION OF THE PREFERRED EMBODIMENTS

Figure 1:
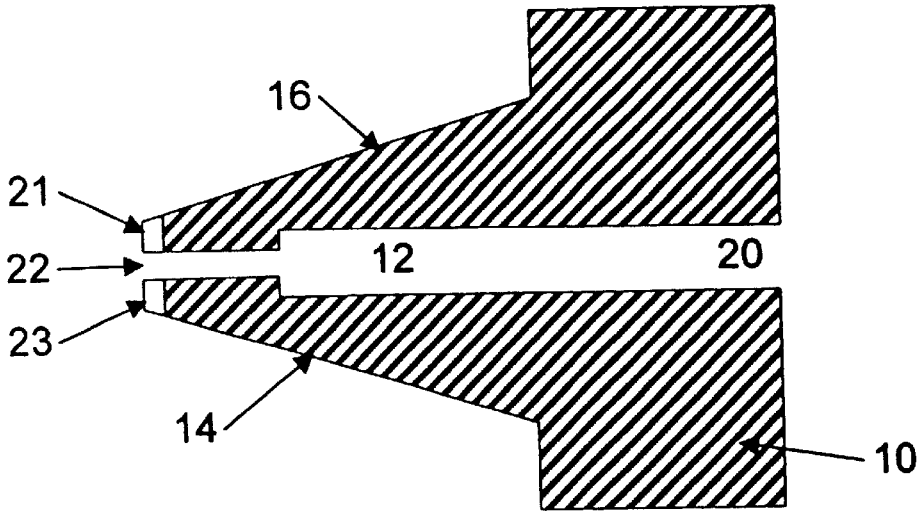
FIG. 1 is a side cross sectional view of a first embodiment the present invention.
Figure 4:
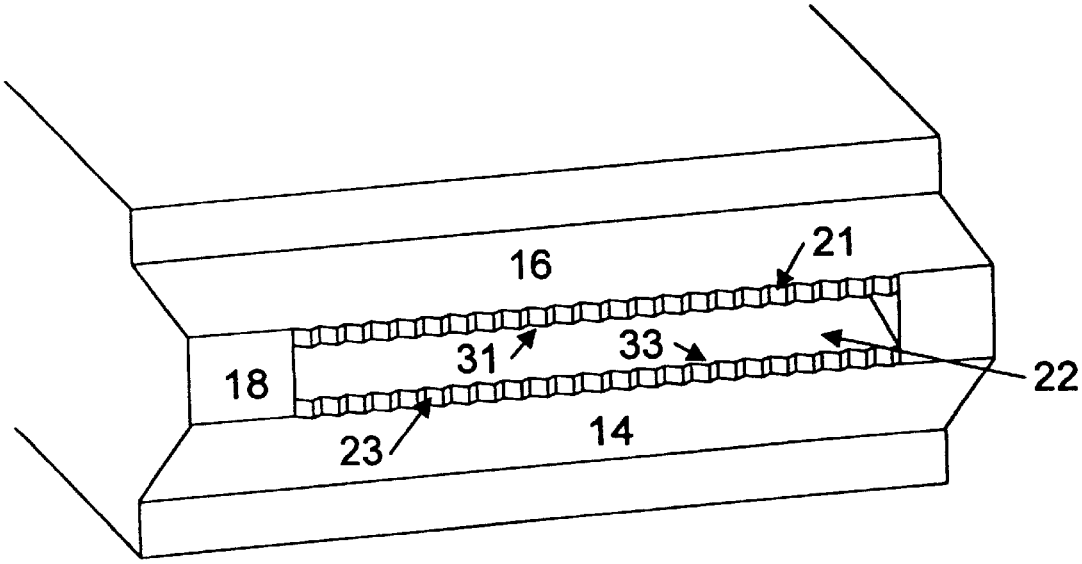
FIG. 4 is an isometric view of a first embodiment of the present invention.

The present invention is directed toward a die nosepiece for a melt blowing device comprising a body 10 defining a resin receiving volume 12. The body comprises a front section 18, as shown in FIG. 4. In a preferred embodiment, the body is made from tool steel.

The invention further comprises a resin inlet 20 in fluid communication with the resin receiving volume 12. The invention further comprises a slit 22 extending across the front section 18. The slit comprises a first side 31 and a second side 33. In a preferred embodiment, the slit extends horizontally across said front section. Resin flows in a downstream direction from the inlet 20 to the slit 22.

Figure 2A:
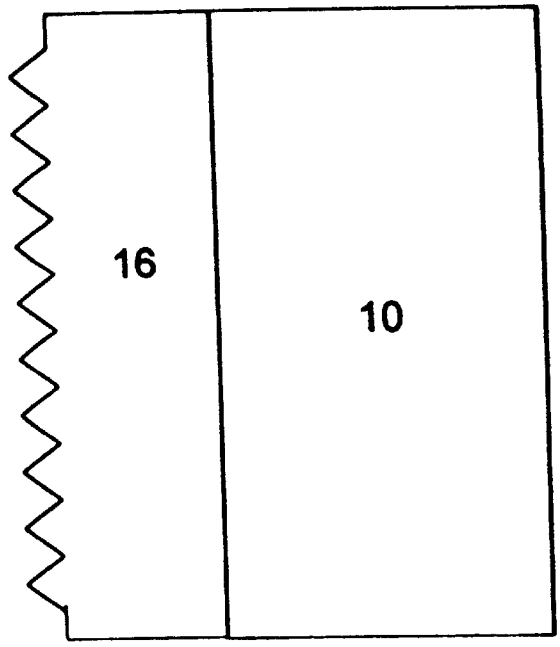
FIG. 2A is a top view of a first embodiment the present invention.
Figure 2B:
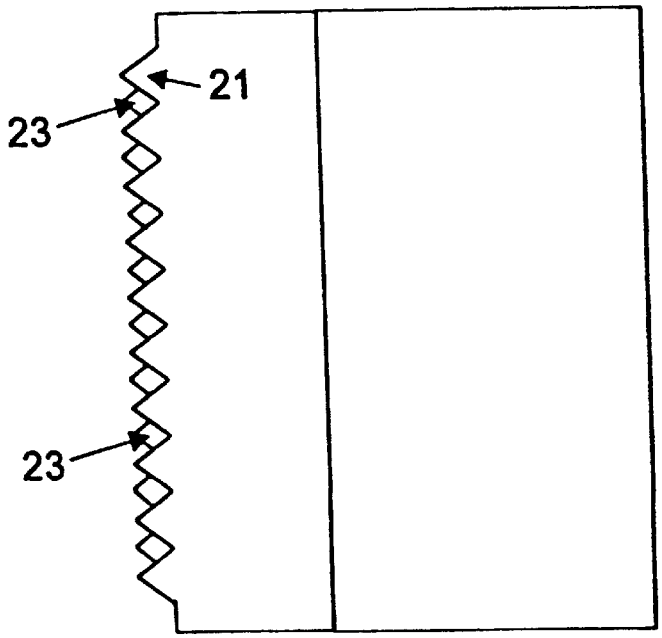
FIG. 2B is a top view of a second embodiment of the present invention.

A serrated first edge 21 is mounted on the front section adjacent the first side 31 of the slit. A serrated second edge 23, is mounted on the front section adjacent the second side 33 of the slit as shown in FIGS. 2A, 2B and 4. In a preferred embodiment, each of the serrated edges extends the length of the slit 22. In the preferred embodiment where the slit extends horizontally across the front section, the first edge is mounted above the slit and the second edge is mounted below the slit.

Figure 3A:
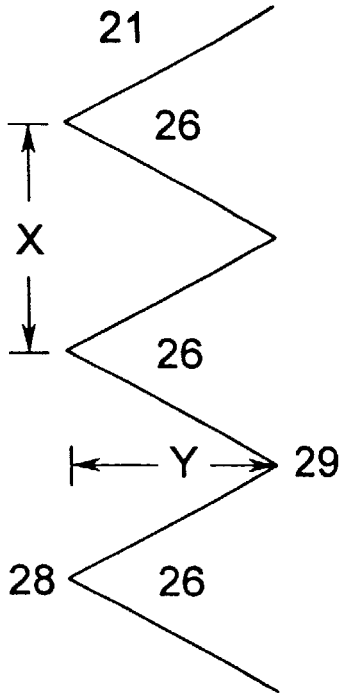
FIG. 3A is an enlarged top view of a portion of a first edge of the present invention.
Figure 3B:
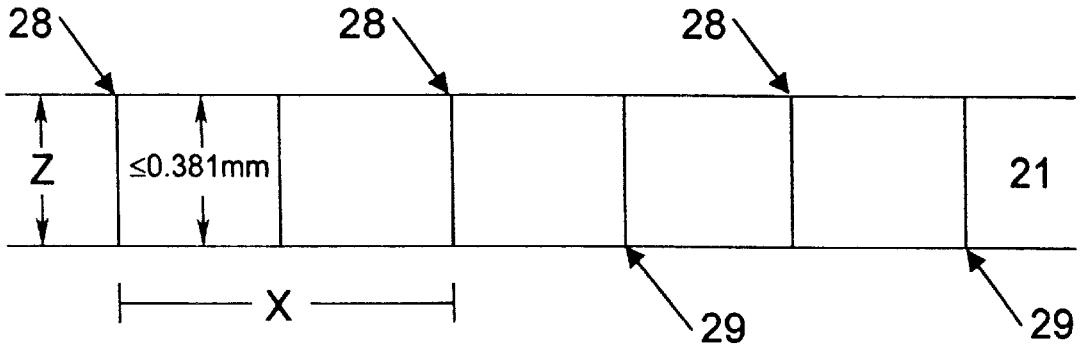
FIG. 3B is an enlarged front view of the portion of the first edge of the present invention shown in FIG. 3A.

The height of each serrated edge, Z, is less than or equal to 0.381 millimeters, as shown in FIG. 3B. It is desirable to make the edges as thin as possible, while still maintaining sufficient structural integrity to withstand the dynamic forces associated with the melt blowing operation. The minimum achievable thickness will vary as a function of several parameters, including material composition of the die, air flow rates, air temperature, and polymer composition.

In a first embodiment of the present invention, the serrations on the first edge are aligned with the serrations on the second edge, as shown in FIGS. 2A and 4. In a second embodiment of the present invention, the serrations on the first edge are offset from the serrations on the second edge, as shown in FIG. 2B.

In a preferred embodiment, the width of the slit is in the range of 0.1–1.0 millimeters. In another preferred embodiment, the width of the slit is constant along its length, as shown in FIG. 4. In a preferred embodiment, the slit extends across at least 80% of the length of the front section, as shown in FIG. 4.

In a preferred embodiment, each edge comprises a multiplicity of serrations 26. Each serration forms a point 28, as shown in FIGS. 3A–3B.

As shown in the figures, the serrations 26 form points 28 which point in the downstream direction of the slit 22. The adjacent sides of adjacent serrations meet to form a corner 29, as shown in FIGS. 3A–3B. The surface tension existing between the resin and the point of each serration is a factor which contributes to the quality of the filaments produced by the present invention. The distance between adjacent serration points is labeled "X" in FIGS. 3A–3B. In a preferred embodiment, the distance X is in the range of 0.7–1.3 millimeters.

The length of each serration is labeled "Y" in FIG. 3A. In a preferred embodiment, the length of each serration is in the range of 0.25–0.76 millimeters.

The foregoing disclosure and description of the invention are illustrative and explanatory. Various changes in the size, shape, and materials, as well as in the details of the illustrative embodiments may be made without departing from the spirit of the invention.

What is claimed is:

1. A die nosepiece for a meltblowing device, comprising:

a. a body defining a resin receiving volume, said body further comprising a front section;

b. a resin inlet in fluid communication with said resin receiving volume; and c. a slit extending across said front section, said slit comprising a first side and a second side;

d. a serrated first edge comprising a multiplicity of first edge serrations, each of said first edge serrations forming a point, such that said first edge serrations point in a downstream direction of the slit, said first edge mounted adjacent said first side of said slit, and having a thickness that is less than or equal to 0.381 millimeters; and e. a serrated second edge comprising a multiplicity of second edge serrations, each of said second edge serrations forming a point, such that said second edge serrations point in the downstream direction of the slit, said second edge mounted adjacent said second side of said slit, and having a thickness that is less than or equal to 0.381 millimeters.

2. The apparatus of claim 1, wherein the length of each of said serrations is in the range of 0.25–0.76 millimeters.

3. The apparatus of claim 1, wherein the distance between adjacent serration points is in the range of 0.7–1.3 millimeters.

4. The apparatus of claim 1, wherein said slit extends across at least 80% of the length of said front section.

5. The apparatus of claim 1, wherein the serrations of said first edge are aligned with the serrations of said second edge.

6. The apparatus of claim 1, wherein the serrations of said first edge are offset from the serrations of said second edge.

7. The apparatus of claim 1 wherein said first and second edges extend the length of said slit.

8. The apparatus of claim 1, wherein the width of said slit is in the range of 0.1–1.0 millimeters.

9. The apparatus of claim 8, wherein the width of said slit is constant along the length of said slit.

10. The apparatus of claim 1, wherein said body is made from tool steel.

* * * * *